United States Patent [19]

Tubbs

[11] 4,302,153

[45] Nov. 24, 1981

[54] ROTOR BLADE FOR A GAS TURBINE ENGINE

[75] Inventor: Henry Tubbs, Shirley, England

[73] Assignee: Rolls-Royce Limited, London, England

[21] Appl. No.: 112,808

[22] Filed: Jan. 15, 1980

[30] Foreign Application Priority Data

Feb. 1, 1979 [GB] United Kingdom ..... 3631/79

[51] Int. Cl.[3] ..... F01D 5/08; F01D 5/18

[52] U.S. Cl. ..... 416/96 R

[58] Field of Search ..... 416/96 R; 415/114

[56] References Cited

U.S. PATENT DOCUMENTS

| | | | |
|---|---|---|---|
| 2,708,564 | 5/1955 | Erickson | 416/96 R |
| 3,314,650 | 4/1967 | McCormick | 416/96 R |
| 3,334,685 | 8/1967 | Burggraf et al. | 415/114 |
| 4,073,599 | 2/1978 | Allen et al. | 416/96 R |
| 4,134,709 | 1/1979 | Eskesen | 416/96 R |

*Primary Examiner*—Robert E. Garrett

*Attorney, Agent, or Firm*—Cushman, Darby & Cushman

[57] ABSTRACT

A rotor blade for a gas turbine engine comprises an aerofoil, shank portion and a root by which the remainder of the blade may be supported from a rotor disc. Cooling for the aerofoil is provided by passages in the leading portion of the aerofoil which are fed with cooling air from an entry aperture and a sealed liquid cooling circuit which contains a cooling liquid. This circuit comprises a liquid feed passage adjacent the trailing edge of the aerofoil and connected adjacent the tip of the aerofoil with a vapor return passage, both passages communicating with a sealed cavity within the shank of the blade. In operation the cooling fluid (e.g. metallic sodium) flows under the influence of centrifugal and other forces along the feed passage, is vaporized and returns to the cavity via the return passage. The cavity acts as a condenser for the fluid.

7 Claims, 3 Drawing Figures

ROTOR BLADE FOR A GAS TURBINE ENGINE

This invention relates to a rotor blade for a gas turbine engine.

In gas turbine engines it is normally necessary to provide some form of cooling for at least the highest pressure stage of turbine rotor blades because these blades take the impact of the hot gases issuing directly from the combustion chamber. Various systems which predominantly use air cooling have been tried and have in general worked in a reasonably satisfactory manner.

However, it has been difficult to cool the thin trailing edge of the aerofoil of these rotor blades and this has in the past lead to the compromising of the aerodynamic design of the trailing edge so as to produce a thicker section which can be more easily cooled.

The present invention provides a rotor blade in which a particularly effective way of cooling the trailing edge is provided.

According to the present invention a rotor blade for a gas turbine engine comprises an aerofoil, a shank portion and a root adapted to engage with a rotor disc so as to support the aerofoil vai the shank, and cooling means for the aerofoil comprising passages in the leading portion of the aerofoil connected to a cooling air entry aperture for the passage of cooling air therethrough, and a sealed cooling fluid circuit in the trailing portion of the aerofoil containing a quantity of cooling fluid and comprising a liquid feed passage closely adjacent to the trailing edge, and a vapour return passage forward of and at least partly divided off from said liquid feed passage by wall portions extending between the flanks of the blade, the feed and return passages communicating with each other at the tip of the blade and communicating with a sealed cavity within the shank of the blade adapted to operate as a condenser of the vapour.

Preferably the feed and return passages are divided from one another by a broken wall, the breaks in the wall forming passages which tend to divert any liquid in the return passage into the feed passage.

There may be separating means where the return passage enters the sealed cavity, the separating means tending to prevent liquid from the cavity feeding into the return passage. Thus this separating means may comprise a raised lip at the entrance to the return passage.

A preferred cooling liquid comprises metallic sodium.

Figure 1:
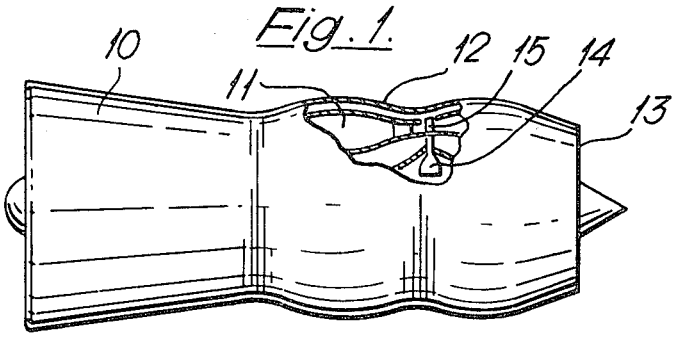
Figure 2:
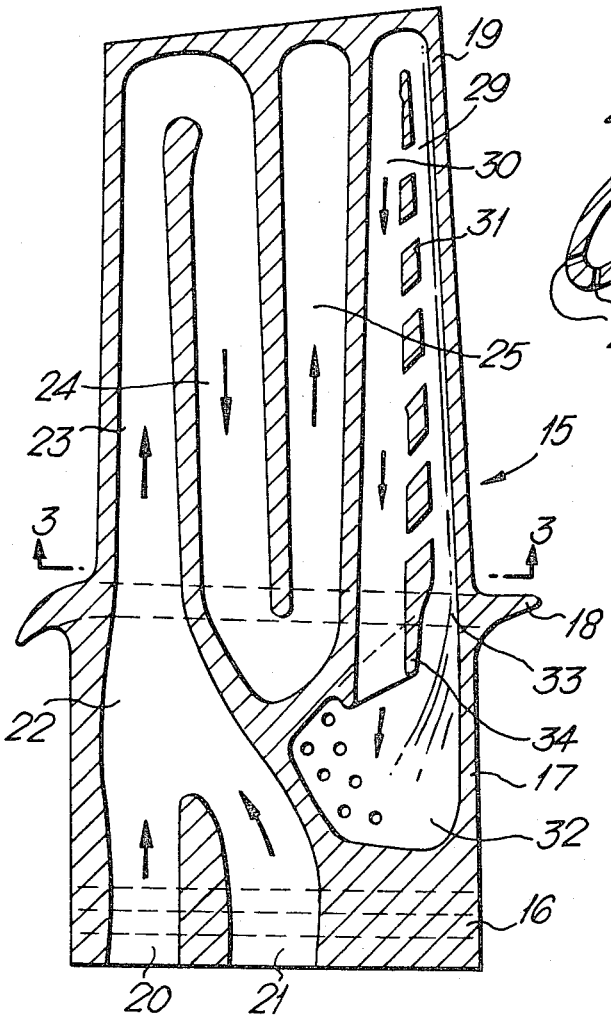
Figure 3:
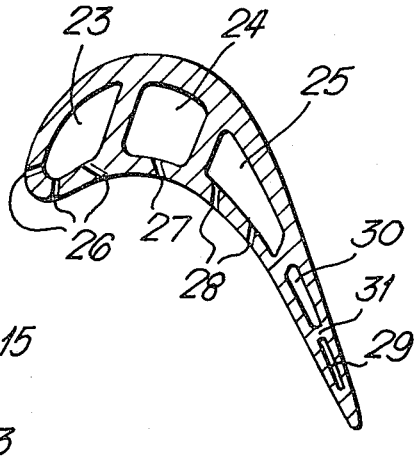

The invention will now now be particularly described, merely by way of example, and with reference to the accompanying drawings in which: p FIG. 1 is a partly broken away view of a gas turbine engine having rotor blades in accordance with the present invention FIG. 2 is a section on the mid-chord line of one of the rotor blades of FIG. 1 and in accordance with the present invention and FIG. 3 is a section on the line 3—3 of FIG. 2.

In FIG. 1 there is shown a gas turbine engine comprisng the conventional components of compressor 10, combustion chamber 11, turbine 12 and final nozzle 13. Overall operation of the engine is conventional and is therefore not described.

The turbine 12 includes a turbine disc 14 from which are carried a stage of rotor blades 15. Because these blades are subject to the effect of the hot gases leaving the combustion chamber 11 it is necessary to provide cooling for the aerofoil portions of the blades.

FIG. 2 illustrates how the blade is cooled. It will be seen that each blade 15 comprises a root portion 16 by which the blade is supported from the turbine disc, a shank 17 extending from the root, a platform portion 18 and an aerofoil 19. As is usually the case the aerofoil 19 performs the aerodynamic function of the blade while the platform 18 defines the inner boundary of the gas flow annulus through the stage of blades. The shank 17 supports the aerofoil and platform from the root.

In the illustrated embodiment the aerofoil is cooled in two ways. Firstly, a feed of cooling air is provided to the base of the root 16 from a source not shown in the drawings. However, it will be appreciated by one skilled in the art that normally this cooling air will be bled from one of the compressors of the engine and blown through nozzles, into a manifold supported from the turbine disc which then allows the air to feed to the bottom of the root 16.

In order to allow the cooling air to enter the blade, apertures 20 and 21 are provided in the base of the root 16. These apertures open onto passages extending substantially longitudinally of the shank and in the present instance these passages join to form a single feed passage 22 in the shank. The air from the passage 22 enters a labyrinthine series of passages 23, 24 and 25. As will be seen from the drawing the passage 23 is adjacent the leading edge of the blade. The passage 24 is adjacent this passage but closer to the mid-section of the blade and the passage 25 lies in the mid-to-rear section of the blade. These passages are joined together at alternate ends so that the cooling air flows radially outwardly in passage 23, radially inwardly in passage 24 and again radially outwardly in passage 25.

Flow of cooling air along these passages in itself provides cooling but in addition each passage features a number of film cooling holes which break through from the passage to the surface of the blade. These passages are best seen in FIG. 3 and it will be seen that in this instance three rows of holes 26 communicate with the passage 23, one row 27 communicates with 24 and two rows 28 communicate with 25.

Although this cooling system operates very effectively where there is sufficient cross-sectional area to introduce passages such as 23, 24 and 25 it will be seen from FIG. 3 that the thinness of the trailing edge makes it difficult to use passages of reasonable size. Therefore a different cooling method is used. Closely adjacent to the trailing edge of the aerofoil a feed passage 29 is formed, the passage 29 being divided from a return passage 30 by a broken wall made up of wall members 31 which extend between the opposite flanks of the aerofoil. The passages 29 and 30 communicate with one another adjacent the tip of the aerofoil and they extend a shortway into the shank 17 where they communicate with a cavity 32. The passages 29 and 30 and the cavity 32 form a sealed system. Within the sealed system there is contained a pre-determined quantity 33 of liquid sodium, the remainder of the sealed space being evacuated.

Other points to note about this sealed system are that where the passage 30 communicates with the cavity 32 a raised lip 34 is formed, this lip projecting towards the root so that it will tend to divert any of the liquid sodium attempting to enter the passage 30 directly from the cavity 32. Also the passage 35 formed between adjacent wall members 31 are canted so that under centrifugal loading they will tend to cause any liquid sodium in the passage 30 to re-enter the passage 29.

Operation of this closed circuit is that the passage 29 acts as a feed passage of the liquid sodium. The sodium will pass radially outwardly along this passage under the influence of centrifugal forces and it will also be appreciated that Coriolis forces will tend to cause the sodium to flow along the wall of the passage 29 which is closest to the trailing edge. As sodium flows along this passage it will vapourise and the resulting vapour will flow into the return passage 30 either by way of the interconnection between the passages at the tip of the blade or else by directly flowing through the passages 35. The vapour then flows inwardly through return passage 30 and back to the cavity 32. Because the cavity 32 lies in the relatively cool blade shank 17 the cavity will act as a condenser and will extract heat from the sodium vapour returning it to its liquid state so that it can commence the cycle again.

It will be understood that the lip 34 assists in maintaining the cycle operating in the sense described and not in the reverse manner which might otherwise be possible. Also the interconnecting passages 35 are angled so that any portion of the liquid sodium moving outwardly in the passage 30 is likely to be caused to flow back into the proper supply passage 29.

It should be noted that it may be necessary to provide some means of improving the heat transfer from the cavity 32 to whatever ambient atmosphere lies around the shank 17. In the FIG. 2 embodiment pedestals 36 are shown which are intended to increase the surface area exposed to the vapour in the cavity and hence to enhance the heat transfer and it may be ncessary to shape the outside of the shank to increase this still further. Additionally it may be advantageous to provide a specific flow of cooling fluid to the shank 17 to remove the heat from sodium.

It should be appreciated that a number of possible variations could be made on the above design. Thus clearly the wall members 31 could form a complete rather than a broken line and it may not in some circumstances be necessary to provide the lip 34. It may also be possible to replace the metallic sodium by a different fluid which would vapourise at the temperatures experienced.

It will be seen that the embodiment described above shows a way in which effective cooling of the blade may be maintained without the considerable weight penalty introduced by liquid cooling systems of the prior art.

I claim:

1. A rotor blade for a gas turbine engine comprising an aerofoil, a shank portion and a root adapted to engage with a rotor disc so as to support the aerofoil via the shank, and cooling means for the aerofoil comprising passages in the leading portion of the aerofoil, a cooling air entry aperture connected to the passages for the flow of cooling air therethrough, and a sealed cooling fluid circuit in the trailing portion of the aerofoil containing a quantity of cooling fluid and comprising a liquid feed passage closely adjacent to the trailing edge, and a vapour return passage forward of said liquid feed passage, wall portions extending between the flanks of the blade which at least partly divide said feed from said return passage, and a sealed cavity within the shank of the blade communicating with the feed and return passages and adapted to operate as a condenser of the vapour.

2. A rotor blade as claimed in claim 1 and comprising a broken wall which divides said liquid feed passage from said vapour return passage.

3. A rotor blade as claimed in claim 2 and in which the breaks in said wall form passages which are directed in operation to divert any liquid in the return passage into the feed passage.

4. A rotor blade as claimed in claim 1 and comprising separating means where the return passage enters the sealed cavity, the separating means in operation tending to prevent liquid from the cavity feeding into the return passage.

5. A rotor blade as claimed in claim 4 and in which said separating means comprises a raised lip at the junction between said return passage and said cavity.

6. A rotor blade as claimed in claim 1 and in which said cavity has an internal surface adpated to improve heat transfer from the cavity to the shank of the blade.

7. A rotor blade as claimed in claim 1 in which the cooling fluid comprises metallic sodium.

* * * * *